US009527623B1

(12) United States Patent
Padden

(10) Patent No.: US 9,527,623 B1
(45) Date of Patent: Dec. 27, 2016

(54) COLLAPSIBLE CONTAINER WITH INNER CONTAINERS AND SLEEVES

(71) Applicant: Stephen Padden, Long Beach, CA (US)

(72) Inventor: Stephen Padden, Long Beach, CA (US)

( * ) Notice: Subject to any disclaimer, the term of this patent is extended or adjusted under 35 U.S.C. 154(b) by 0 days.

(21) Appl. No.: 15/068,557

(22) Filed: Mar. 12, 2016

Related U.S. Application Data

(60) Provisional application No. 62/131,982, filed on Mar. 12, 2015.

(51) Int. Cl.

| | |
|---|---|
| ***B65D 6/24*** | (2006.01) |
| ***B65D 25/04*** | (2006.01) |
| ***B65D 1/34*** | (2006.01) |
| *A45C 11/00* | (2006.01) |

(52) U.S. Cl.
CPC ..... *B65D 11/1866* (2013.01); *B65D 1/34* (2013.01); *B65D 25/04* (2013.01); *A45C 11/008* (2013.01)

(58) Field of Classification Search
CPC ..... B65D 11/1866; B65D 11/18; B65D 1/36; B65D 1/34; B65D 25/10; B65D 21/0204; B65D 21/0202; B65D 21/0201; B65D 21/02; A45C 11/008; A45C 5/005; A45D 27/22
USPC ..... 220/4.28, 4.33, 4.34, 556, 555, 553, 507,220/23.86, 23.83, 630, 628, 629; 206/581, 228, 206/223, 216, 549, 546, 542, 577, 736, 762, 206/764, 756; 132/314, 286
See application file for complete search history.

(56) References Cited

U.S. PATENT DOCUMENTS

| | | | | |
|---|---|---|---|---|
| 1,828,092 A | | 9/1922 | Honma | |
| 1,637,553 A | * | 8/1927 | Coleman | B65D 1/42 190/18 R |
| 1,973,283 A | * | 9/1934 | Buttrick | A45C 5/005 190/111 |
| 2,790,301 A | | 4/1957 | Dintsman | |
| 5,941,255 A | * | 8/1999 | Chen | A45C 5/005 132/286 |
| 6,415,915 B1 | | 7/2002 | Grossman | |
| 7,784,609 B2 | | 8/2010 | Frost | |
| 8,678,185 B1 | | 3/2014 | Lin | |
| 2003/0230499 A1 | * | 12/2003 | Wagner | B65D 5/4275 206/216 |

FOREIGN PATENT DOCUMENTS

JP 2011251720 A 12/2011

* cited by examiner

*Primary Examiner* — Robert J Hicks
(74) *Attorney, Agent, or Firm* — Quickpatents, LLC; Kevin Prince

(57) ABSTRACT

A collapsible container for holding items above a support surface when in a deployed configuration, and for substantially sealing the items within the container when in a collapsed configuration, comprises an elongated inner container having an outer surface, two opposing ends and a central storage cavity between the ends for receiving the items therein. Two hollow sleeves are each open at a first end thereof, and two attachment mechanisms are each fixed between one of the ends of the inner container and the first end of one of the hollow sleeves. In use, in the collapsed configuration the sleeves cover the opposing ends of the inner container, and in the deployed configuration each sleeve is fixed proximate the first open end thereof with one end of the inner container to support the inner container above the support surface.

21 Claims, 10 Drawing Sheets

COLLAPSIBLE CONTAINER WITH INNER CONTAINERS AND SLEEVES

CROSS-REFERENCE TO RELATED APPLICATIONS

This application claims the benefit of U.S. Provisional Patent Application 62/131,982, filed on Mar. 12, 2015, and incorporated herein by reference.

STATEMENT REGARDING FEDERALLY SPONSORED RESEARCH AND DEVELOPMENT

Not Applicable.

FIELD OF THE INVENTION

This invention relates to containers, and more particularly to a collapsible container.

DISCUSSION OF RELATED ART

Containers are some of the most fundamental items of daily life. However, many containers have detachable lids or other elements that are easily lost, rending the container useless. Further, most containers do not provide for deployed configuration wherein items stored within are conveniently presented for use, and then collapse down to a sealed, compact collapsed configuration for storage and/or travel.

Therefore, there is a need for a container device that is self-contained and easily configurable between a deployed configuration for presenting the items held therein, and a collapsed configuration securely sealing the items therein and assuming a compact size facilitating travel or storage. Such a needed invention would provide many configuration options for holding disparate items. Moreover, such a needed container device would be relatively easy to manufacture, transport, store and use. The present invention accomplishes these objectives.

SUMMARY OF THE INVENTION

The present device is a collapsible container for holding items above a support surface when in a deployed configuration, and for substantially sealing the items within the container when in a collapsed configuration. The collapsible container comprises an elongated inner container having an outer surface, two opposing ends and a central storage cavity between the ends for receiving the items therein. The storage cavity may be divided into a plurality of compartments with at least one compartment divider.

Two hollow sleeves are each open at a first end thereof. The sleeves may be closed or open at an opposing second end thereof. The sleeves are adapted for substantially covering up to one-half of the inner container. Two attachment mechanisms are each fixed between one of the ends of the inner container and the first end of one of the hollow sleeves. Each attachment mechanism is adapted to attach the hollow sleeve with the end of the inner container at a support angle, such as 90-degrees.

In use, in the collapsed configuration the sleeves cover the opposing ends of the inner container, and in the deployed configuration each sleeve is fixed proximate the first open end thereof with one end of the inner container to support the inner container above the support surface. As such, in the deployed configuration the hollow sleeves act as support legs to hold the inner container above the support surface, and as receptacles for temporarily storing and presenting the items in a generally vertical and sanitary fashion.

The attachment mechanism may be a pivot arrangement wherein the hollow sleeve takes a U-shaped form and is not typically removed from the inner container. Alternately, each hollow sleeve is completely separable from the inner container, wherein the open first end of each hollow sleeve is first removed from the inner container and then affixed to one end of the inner container with the attachment mechanism. In some cases, each hollow sleeve may be captive to the inner container once the collapsible container is fully assembled.

A removable shallow tray may be included for holding some of the items, with other of the items being retained in the central storage cavity below the removable tray. In some embodiments, the removable tray, when inverted, acts as a cover adapted to substantially cover the central storage cavity. With such embodiments including the cover, the hollow sleeves are preferably cooperative with the cover to lock the cover in place over the central storage cavity when the container is in the collapsed configuration. In some embodiments, the central storage cavity further includes at least one fold-out tray pivotally attached with the central storage cavity by at least one pivot.

Preferably each hollow sleeve covers substantially one-half of the length of the inner container when in the collapsed configuration, wherein the open first ends of the hollow sleeves abut when in the collapsed configuration. In such embodiments, the open ends of each hollow sleeve preferably include a mutual locking mechanism, such as magnets, detents, mechanical snaps, or the like, such that when in the collapsed configuration the open first ends of each sleeve may be selectively locked together to lock the collapsible container into the collapsed configuration.

The present invention is a container device that is self-contained and easily configurable between a deployed configuration for presenting the items held therein, and a collapsed configuration securely sealing the items therein and assuming a compact size facilitating travel or storage. The present device provides many configuration options for holding disparate items, and is relatively easy to manufacture, transport, store and use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
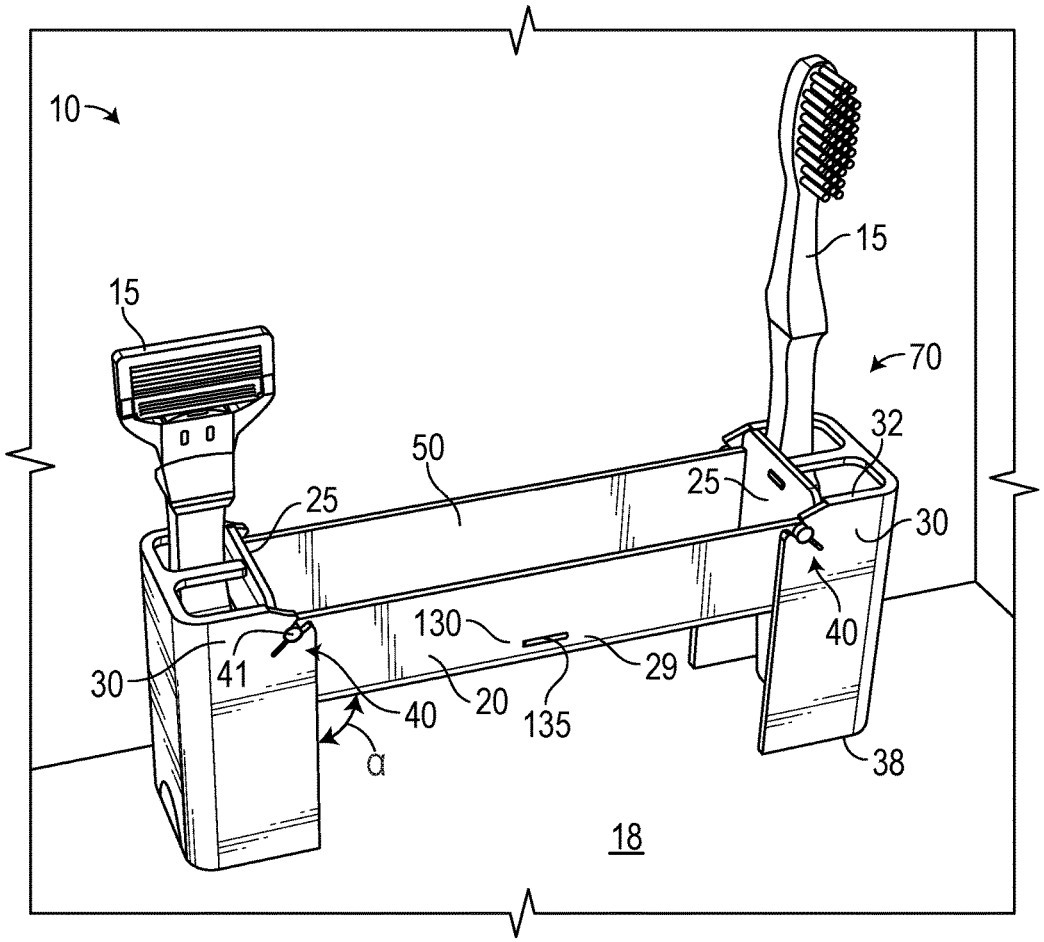
FIG. 1 is a perspective view of a first embodiment of the invention, illustrated in a deployed configuration and shown holding two items in a generally vertical orientation on a support surface.
Figure 2:
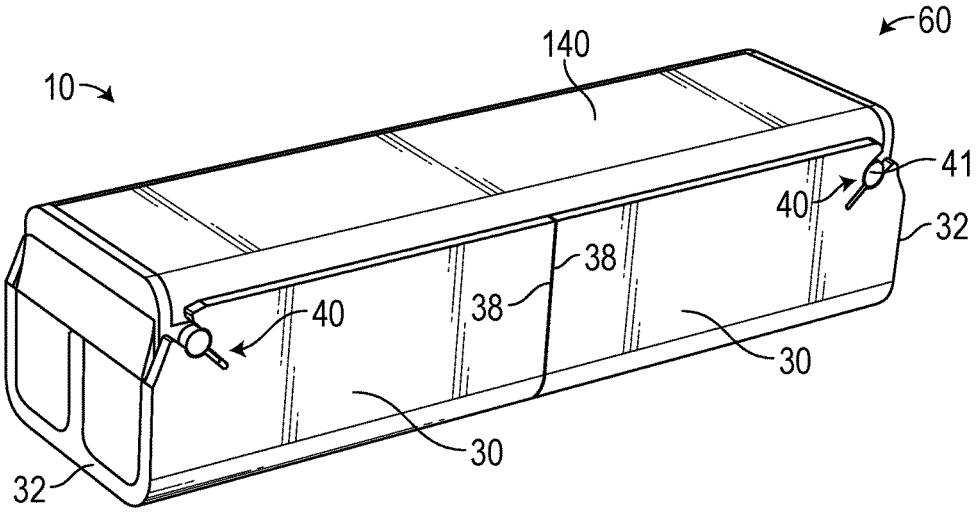
FIG. 2 is a perspective view of the first embodiment, illustrated in a collapsed configuration.

FIGS. 1 and 2 illustrate a collapsible container 10 for holding items 15 above a support surface 18, such as a countertop, when in a deployed configuration 70, and for substantially sealing the items 15 within the container 10 when in a collapsed configuration 60. Such items 15 may be, for example, toiletry kit items such as a toothbrush, razor, cosmetic brush, floss container, tweezers, or the like. Alternately such items 15 may be medical kit items such as medications, bandages, tourniquets, smelling salts, ointments, or the like. Alternately such items 15 may be cosmetic items such as cosmetics, brushes, scissors, clippers, or the like. Office supply items 15 may be retained in such a collapsible container 10, such as pens, pencils, paperclips, staples, note pads, or the like. Art supply items 15 may be included in an art kit embodiment, comprising paint holding trays, paint brushes, water-tight water cups, or the like. Clearly a wide variety of different types of items 15 may be retained in the collapsible container 10 as desired.

Figure 14:
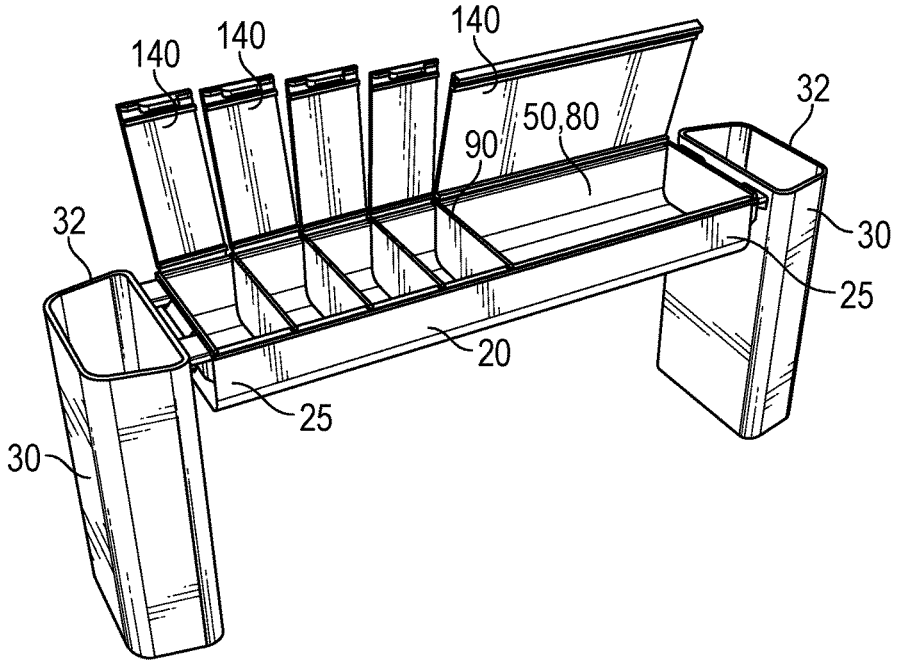
FIG. 14 is a perspective view of a sixth embodiment, illustrated in the deployed configuration and further illustrating a plurality of compartments each sealable with a pivoting cover.

The collapsible container 10 comprises an elongated inner container 20 having an outer surface 29, two opposing ends 25 and a central storage cavity 50 between the ends 25 for receiving the items 15 therein. The storage cavity 50 may be divided into a plurality of compartments 80 with at least one compartment divider 90 (FIGS. 7, 8, 12 and 14) and one or more covers 140, perhaps each cover 140 pivotally attached with the inner container 20 and adapted to cover a single compartment 80, such as in a weekly medication holder embodiment (FIG. 14). Clearly the form of the storage cavity 50, compartments 80, and dividers 90 may be adjusted as desired based on the application and type of items 15 to be stored. Preferably the inner container 20 is made with an injection-molded plastic material, or the like.

Figure 7:
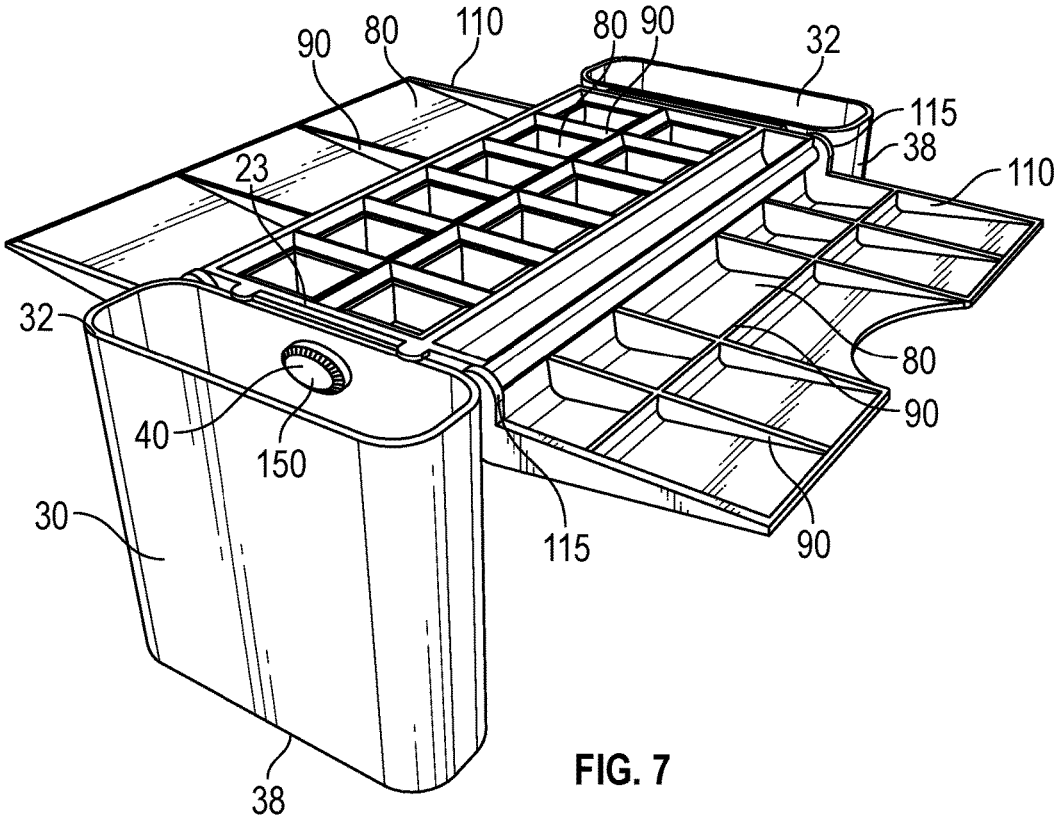
FIG. 7 is a perspective view of the third embodiment, illustrated in the deployed configuration.
Figure 8:
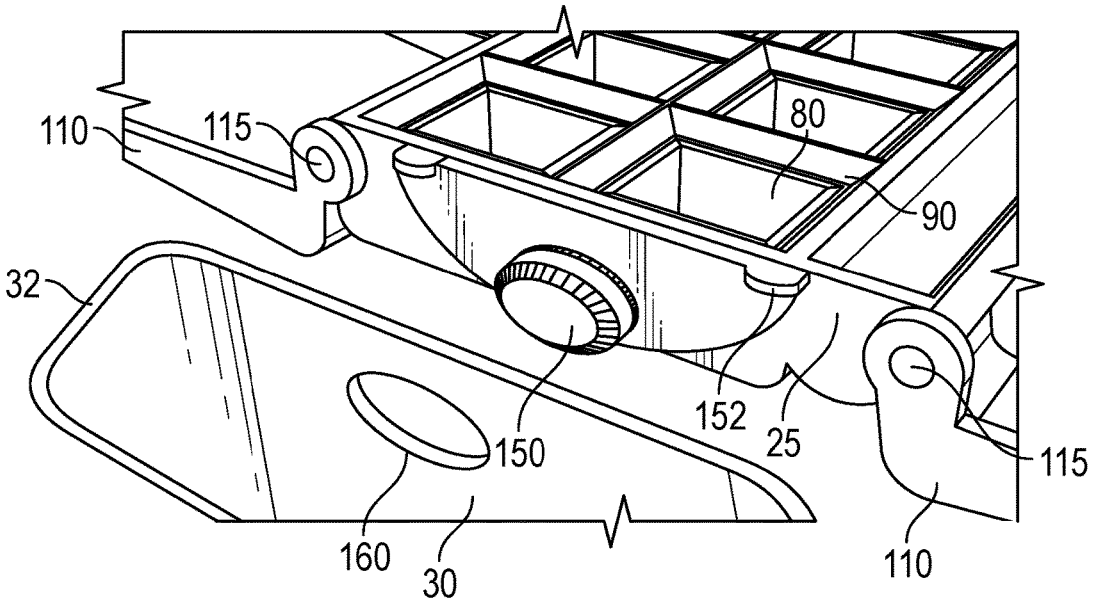
FIG. 8 is a partial perspective view of the third embodiment, illustrating an attachment means between an end of the internal container and one of the hollow sleeves.
Figure 9:
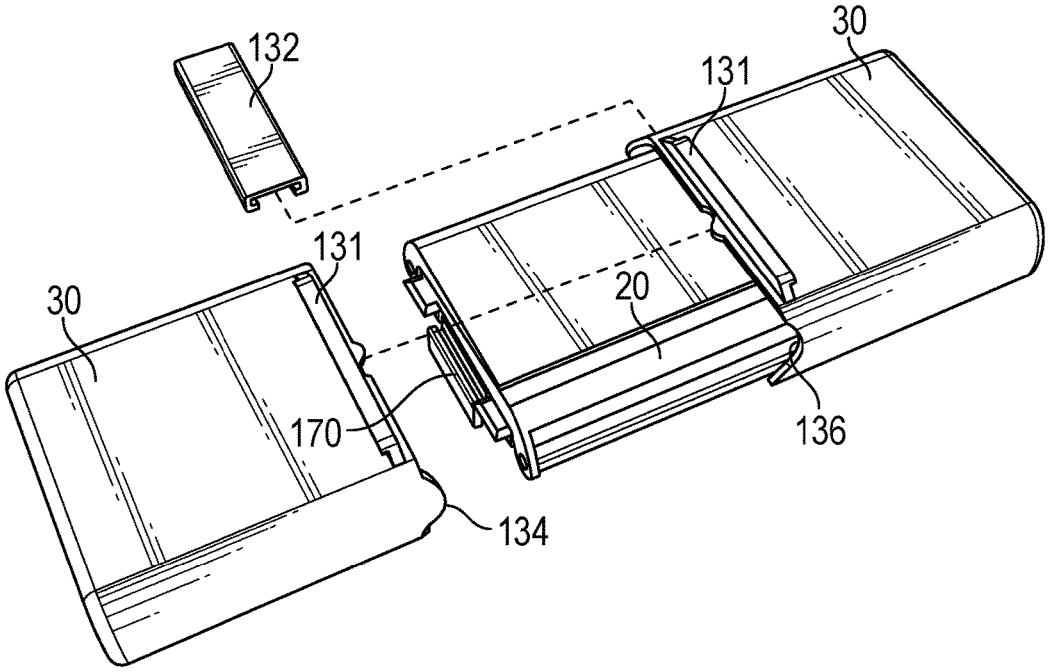
FIG. 9 is a partially-exploded perspective view of a fourth embodiment of the invention, illustrating one of the hollow sleeves removed from the internal container and further showing one embodiment of a mutual locking mechanism that includes two flanges on each hollow sleeve and a sliding clip.

Two hollow sleeves 30 are each open at a first end 32. The sleeves 30 may be closed or open at an opposing end 38. In some embodiments, the sleeves 30 are closed at the opposing end 38 and water tight so as to be fillable with a liquid such as water, paint thinner, or the like (FIG. 7). Each sleeve 30 may be made using an extrusion process and then fitted with a plastic or elastomeric cap on the second end 38, or the sleeve 30 may be plastic injection molded or the like with the second end 38 closed. The sleeves 30 are adapted for substantially covering up to one-half of the inner container 20.

Two attachment mechanisms 40 are each fixed between one of the ends 25 of the inner container 20 and the first end 32 of one of the hollow sleeves 30. Each attachment mechanism 40 is adapted to attach the hollow sleeve 30 with the end 25 of the inner container 20 at a support angle α (FIG. 1).

In use, in the collapsed configuration 60 the sleeves 30 cover the opposing ends 25 of the inner container 20, and in the deployed configuration 70 each sleeve 30 is fixed proximate the first open end 32 thereof with one end 25 of the inner container 20 to support the inner container 20 above the support surface 18. As such, in the deployed configuration 70 the hollow sleeves 30 act as support legs to hold the inner container 20 above the support surface 18.

Figure 3:
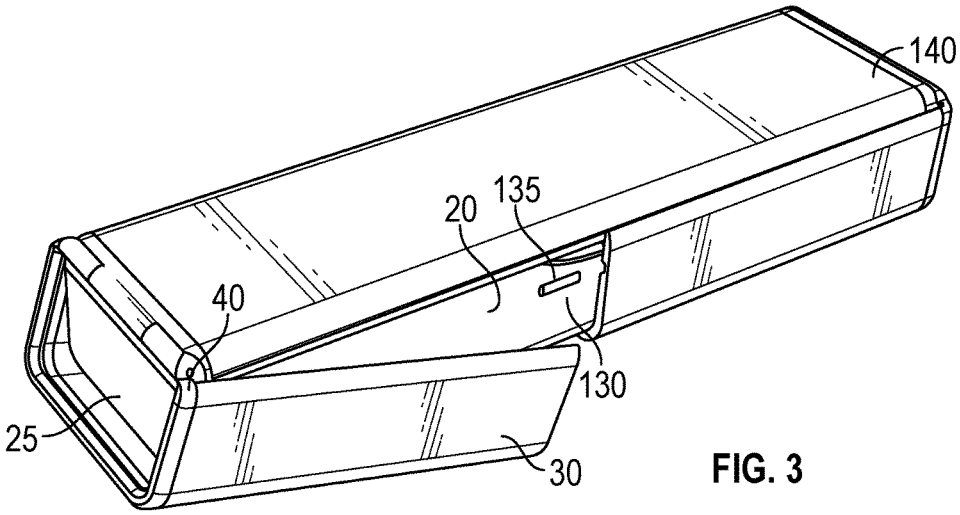
FIG. 3 is a perspective view of a second embodiment of the invention, illustrated partially in the collapsed configuration.

In one embodiment the attachment mechanism 40 is a pivot arrangement 41 (FIGS. 1-3) wherein the hollow sleeve takes a U-shaped form and is not typically removed from the inner container 20. In such an embodiment the U-shaped form cradles the bottom of the inner container 20 in the collapsed configuration 60, and preferably cooperates with a removable cover 140 to cover the central storage cavity 50. Alternately, each hollow sleeve is completely separable from the inner container 20 (FIGS. 6, 8, 9 and 11), wherein the open first end 32 of each hollow sleeve 30 is first removed from the inner container 20 and then affixed to one end 25 of the inner container 20 with the attachment mechanism 40.

Figure 15:
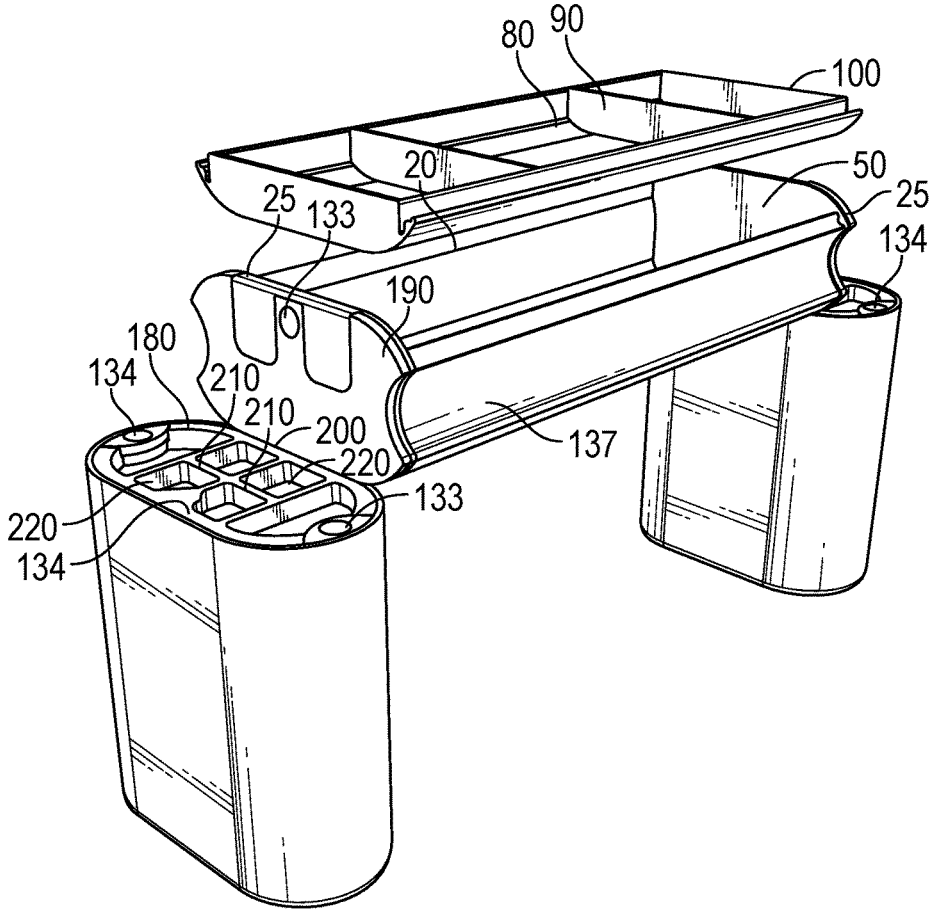
FIG. 15 is an exploded perspective view of a seventh embodiment, illustrating another embodiment of the attachment means and a shallow removable tray.
Figure 22:
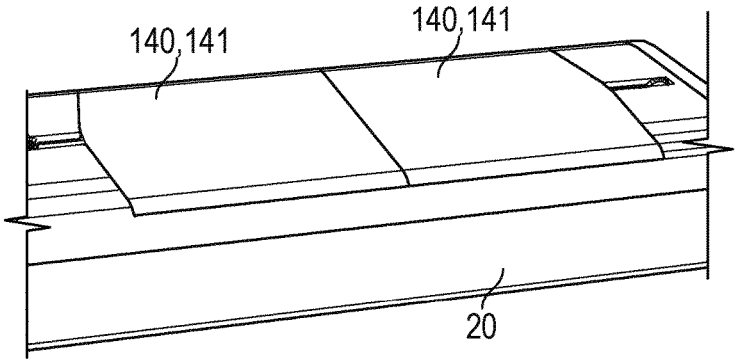
FIG. 22 is a partial perspective view of a ninth embodiment of the invention, illustrated in the collapsed configuration but with the hollow sleeves omitted for clarity of illustration.
Figure 23:
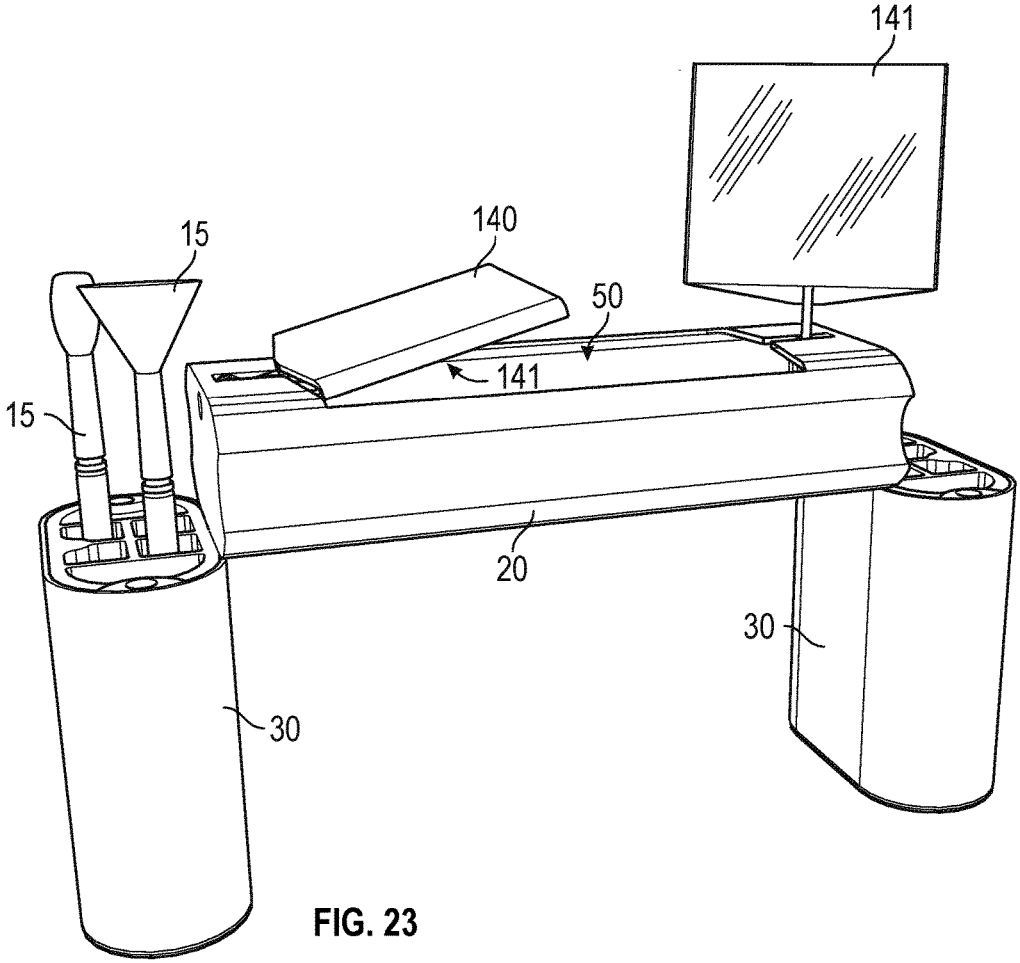
FIG. 23 is a perspective view of the ninth embodiment of the invention, illustrated in the deployed configuration with combination covers and adjustable mirrors.

A removable shallow tray 100 (FIGS. 15 and 16) may be included for holding some of the items 15, with other of the items 15 being retained in the central storage cavity 50 below the removable tray 100. In some embodiments, the removable tray 100, when inverted, acts as a cover 140 adapted to substantially cover the central storage cavity 50. With such embodiments including the cover 140, the hollow sleeves 30 are preferably cooperative with the cover 140 to lock the cover 140 in place over the central storage cavity 50 when the container is in the collapsed configuration 60. In one embodiment, the cover 140 includes a mirror 141 (FIGS. 22 and 23) that can be used when applying cosmetic items 15 stored in the collapsible container 10, for example. Such a mirror 141 may be fixed with the inner container 20 with a ball joint (not shown) or the like so that when in use in the deployed configuration 70, the mirror 141 may be tilted and rotated into a desired angle for use.

In some embodiments, the central storage cavity 50 further includes at least one fold-out tray 110 pivotally attached with the central storage cavity 50 by at least one pivot 115 (FIGS. 5-8). As such, when in the deployed configuration 70, the at least one fold-out tray 110 may be pivoted about the central storage cavity 50 for holding at least one of the items 15. As shown, the at least one pivot 115 extends outwardly from the end 25 of the inner container 20, so the attachment mechanism 40 must also include a spacer to ensure that the hollow sleeves 30 do not interfere with the operation of the at least on pivot 115. The fold-out tray 110 is useful to hold paint, cosmetics, and like items 15 as a painter's pallet, and may also include removable paint "half pans" and a thumb depression 112 (FIG. 7) for holding the container 10 by hand if desired.

Figure 13A:
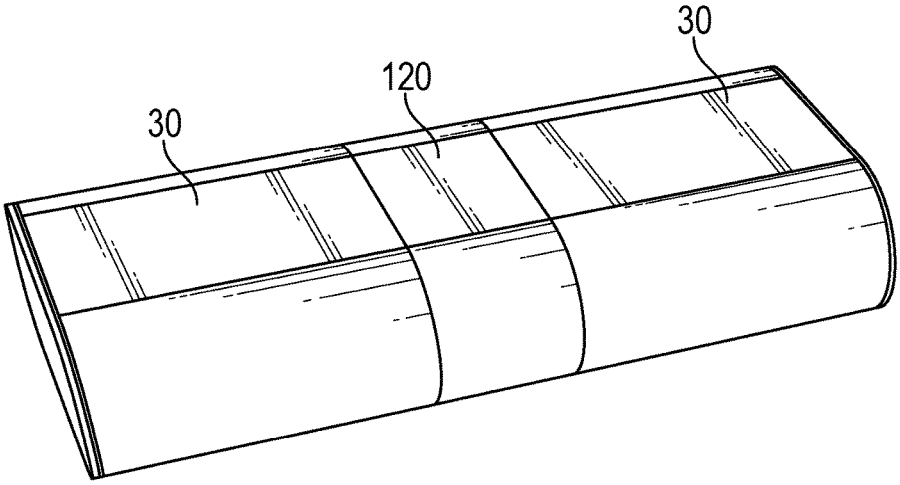
FIG. 13A is a perspective view of a fifth embodiment, illustrated in the collapsed configuration.
Figure 13B:
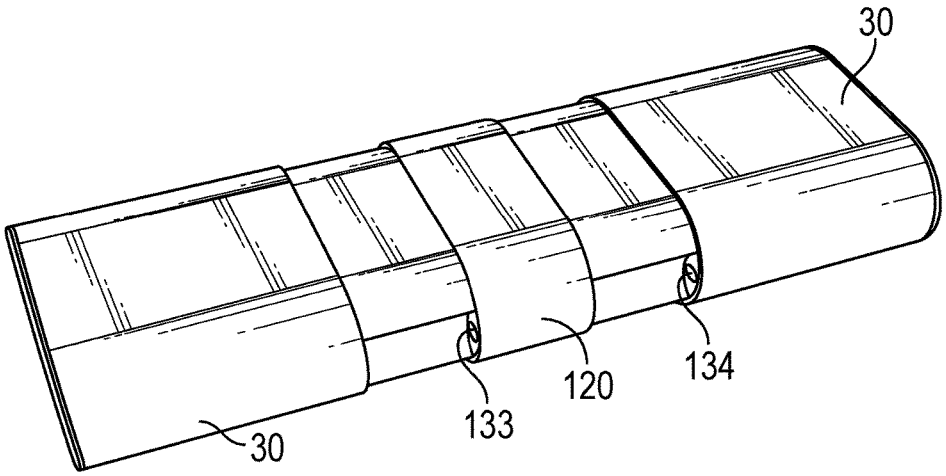
FIG. 13B is a perspective view of the fifth embodiment, illustrated with the hollow sleeves partially removed from the inner container.

In some embodiments, each sleeve 30 covers less than one-half of the length of the inner container 20 when in the collapsed configuration 60, and the inner container 20 includes a central raised section 120 (FIGS. 13A and 13B) that abuts the open first ends 32 of the hollow sleeves 30 when in the collapsed configuration 60.

Figure 5:
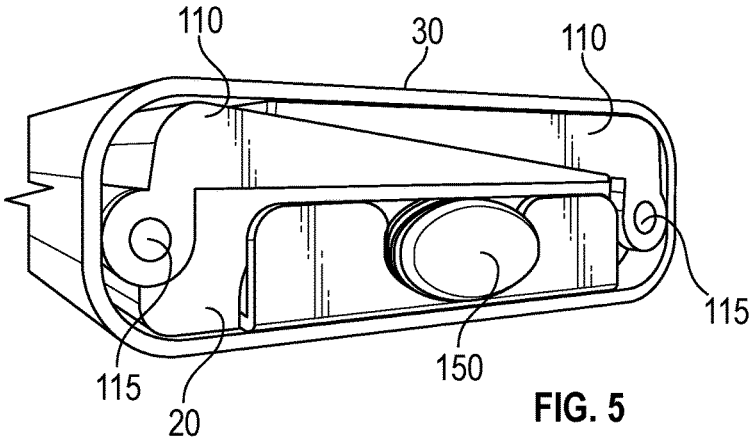
FIG. 5 is a perspective view of the third embodiment, partially cut-away to reveal the inner container and two fold-out trays thereof.
Figure 6:
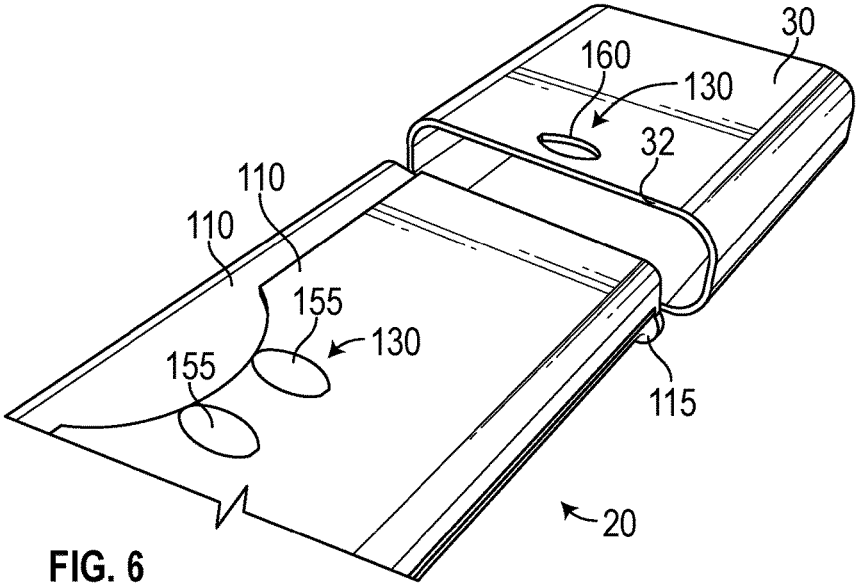
FIG. 6 is a partial perspective view of the third embodiment, illustrated with the hollow sleeves removed from the inner container.
Figure 10:
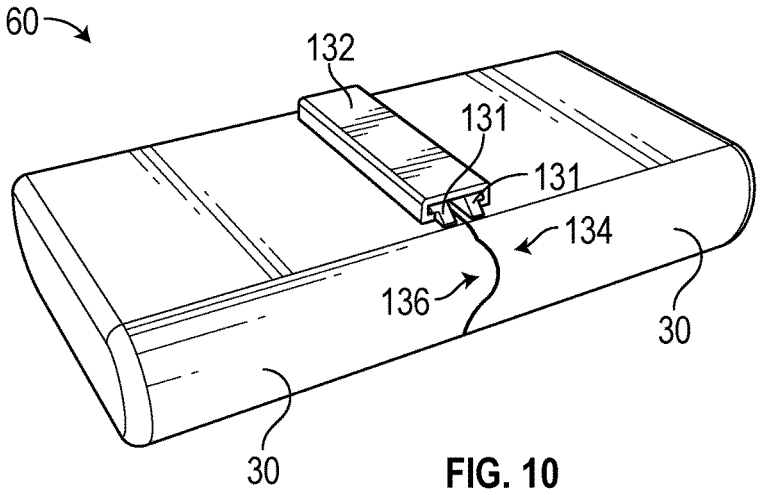
FIG. 10 is a perspective view of the fourth embodiment, illustrated in the collapsed configuration.
Figure 11:
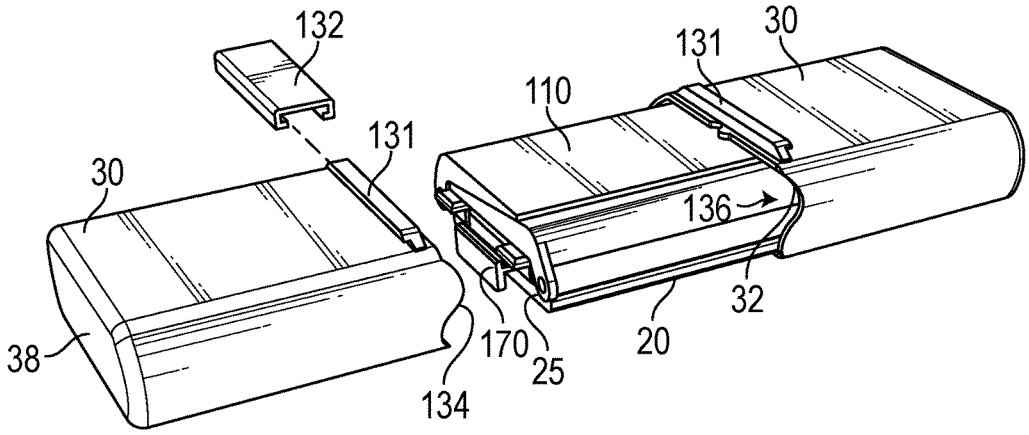
FIG. 11 is an alternate perspective view of FIG. 9, illustrating one embodiment of the attachment means.
Figure 12:
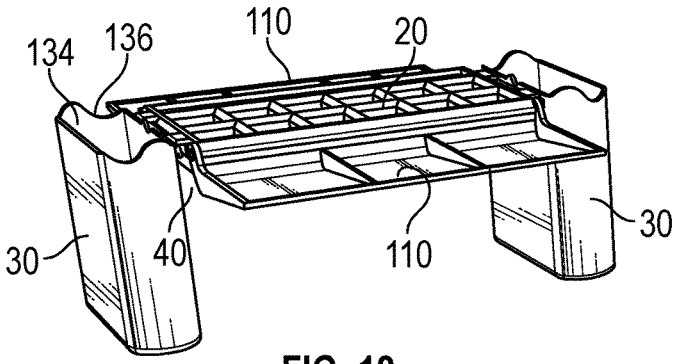
FIG. 12 is a perspective view of the fourth embodiment, illustrated in the deployed configuration.

Alternately, each hollow sleeve 30 covers substantially one-half of the length of the inner container 20 when in the collapsed configuration 60, wherein the open first ends 32 of the hollow sleeves 30 abut when in the collapsed configuration 60 (FIGS. 2, 5 and 10). In such embodiments, the open ends 32 of each hollow sleeve 30 preferably include a mutual locking mechanism 130 such that when in the collapsed configuration 60 the open first ends 32 of each sleeve 30 may be selectively locked together to lock the collapsible container 10 into the collapsed configuration 60.

One such mutual locking mechanism 130 includes a flange 131 proximate the open first end 32 of each hollow sleeve 30, and a clip 132 that is selectively slidable around each flange 131 to secure the flanges 131 together and lock the collapsible container 10 into the collapsed configuration 60. In such an embodiment, the flange 131 of each hollow sleeve 130 is also cooperative with a flange retaining mechanism 170 (FIGS. 9 and 11) fixed with each end 25 of the inner container 20 to selectively hold each hollow sleeve 30 to the end 25 of the inner container 20 in the deployed configuration 70.

Figure 16:
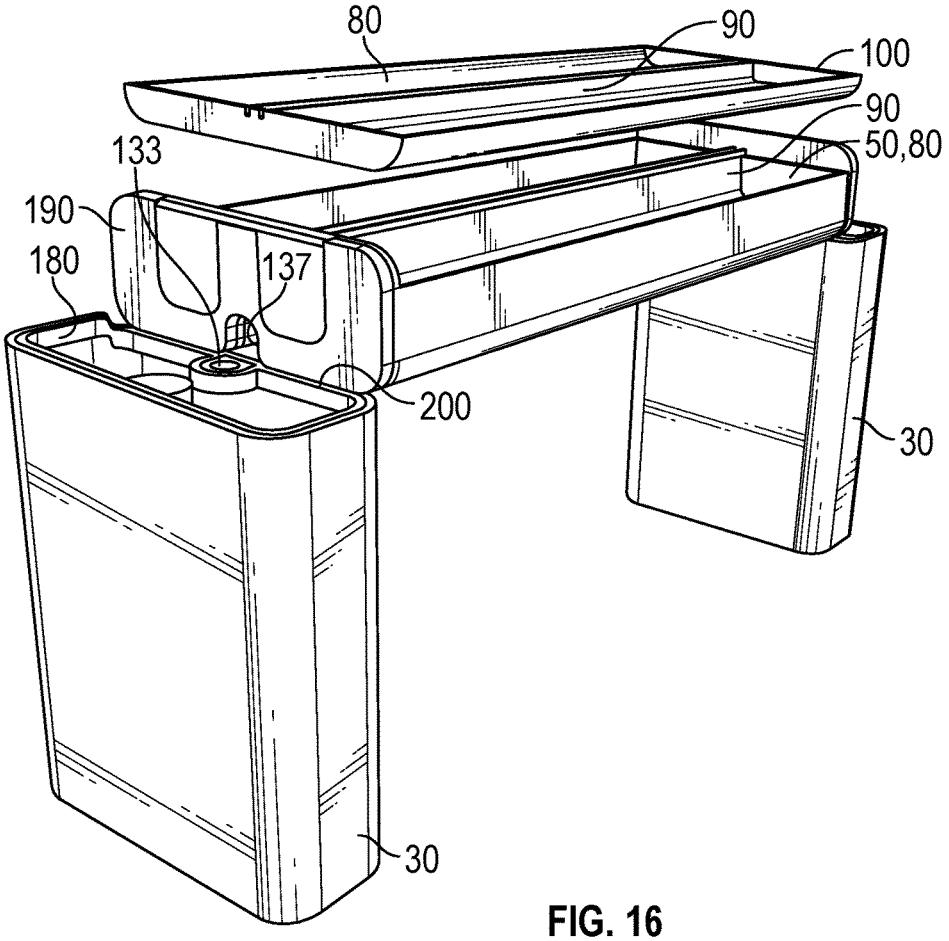
FIG. 16 is an exploded perspective view of an eighth embodiment, illustrating another embodiment of the attachment means and another embodiment of the shallow removable tray.
Figure 17:
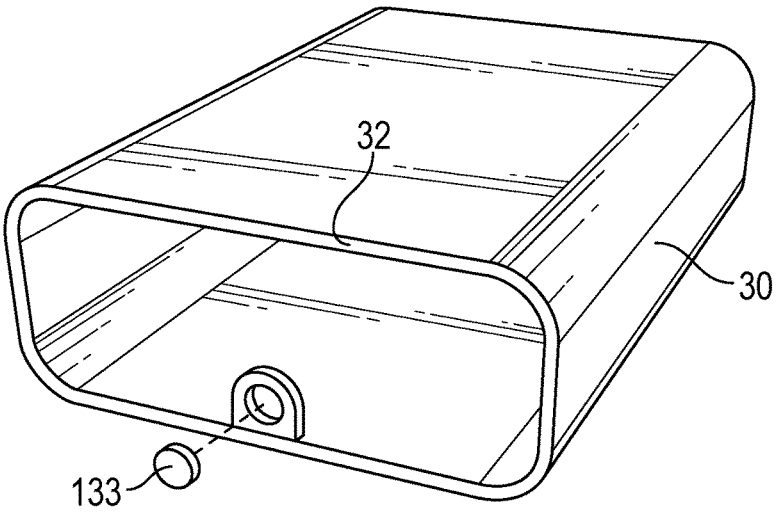
FIG. 17 is an exploded perspective view of one embodiment of one of the hollow sleeves, illustrated with a magnet thereof exploded away from the sleeve.
Figure 18:
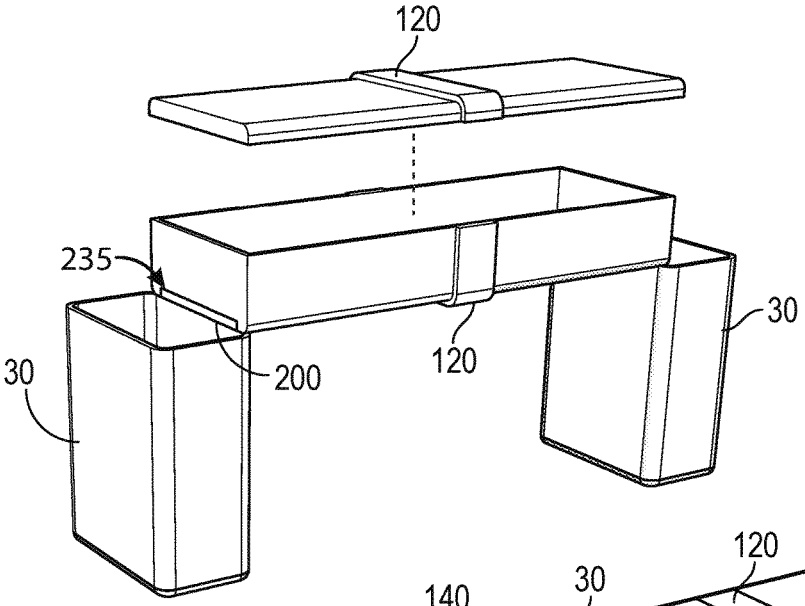
FIG. 18 is an exploded perspective view of an eighth embodiment of the invention, illustrated in the deployed configuration.
Figure 19:
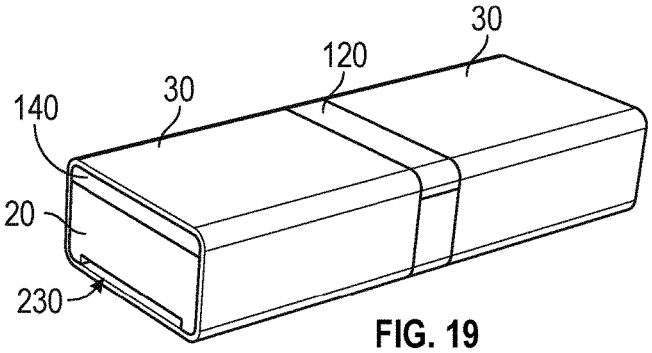
FIG. 19 is a perspective view of the eighth embodiment in the collapsed configuration.
Figure 20:
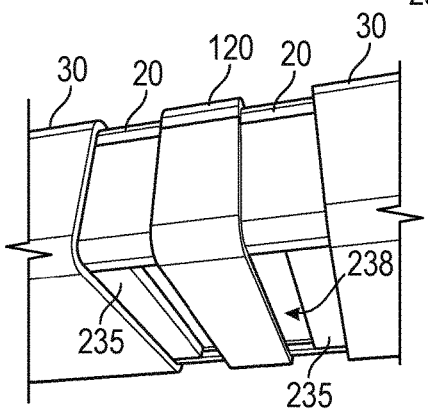
FIG. 20 is a partial enlarged bottom perspective view of a retaining bar and recess of the eighth embodiment as the hollow sleeves approach the collapsed configuration.
Figure 21:
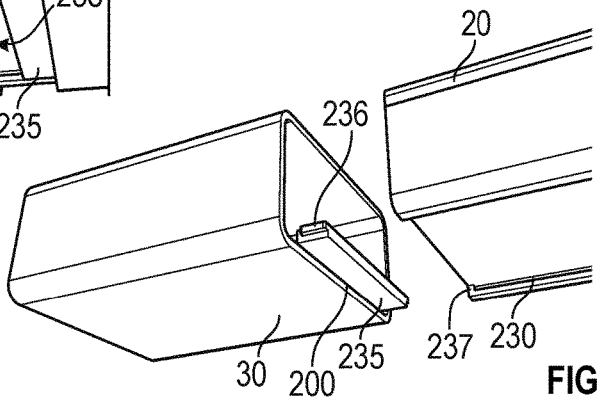
FIG. 21 is an exploded partial perspective view of the eight embodiment, illustrating the retaining bar and a retaining prong thereof.

Another such mutual locking mechanism 130 includes at least one magnet 133 (FIGS. 15-17) fixed with the open first end 32 of at least one of the hollow sleeves 20, and at least one magnetically attractive material 134 (which could include another magnet 133) fixed with the open first end 32 of at least one of the other hollow sleeves 30, such that when the open first ends 31 of the hollow sleeves 30 abut, the at least one magnet 133 is magnetically fixed with the at least one magnetically attractive material 134 to lock the collapsible container 10 in the collapsed configuration 60. To accommodate the size of the magnet 133, a recessed track 137 (FIGS. 14-17) may be formed in the inner container 20 along which the magnets 133 of each hollow sleeve 30 slide. Two such tracks 137 may be formed in sides of the inner container 20 (FIG. 15), or one track 137 may be formed in a bottom side of the inner container (FIGS. 16 and 17).

Another such mutual locking mechanism 130 includes at least one detent 135 (FIGS. 1 and 3) fixed with the outer surface 29 of the inner container 20. Each detent 135 cooperates with each of the hollow sleeves 135 to frictionally hold the collapsible container 10 in the collapsed configuration 60.

Figure 4:
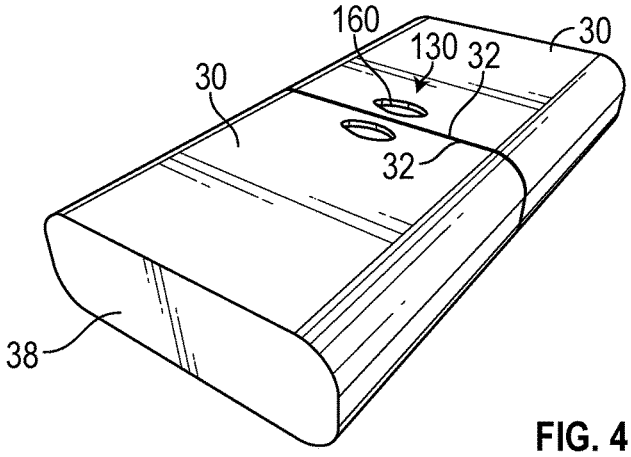
FIG. 4 is a perspective view of a third embodiment of the invention, illustrated in the collapsed configuration with two hollow sleeves substantially covering an internal container.

Another such mutual locking mechanism 130 includes two resilient buttons 155 (FIGS. 4 and 6), preferably made from an elastomeric or plastic material, fixed with the outer surface 29 of the inner container 20. Such resilient buttons 155 each cooperate with a prong aperture 160 traversing each of the hollow sleeves 30 proximate the open first end 32 thereof to frictionally hold the collapsible container 10 in the collapsed configuration 60. Further, each attachment mechanism 40 may include a resilient prong 150 (FIGS. 7 and 8) that is also adapted for selective attachment through the prong aperture 160 to retain the hollow sleeve 30 on the end 25 of the inner container 20 in the deployed configuration 70. In such an embodiment, projecting stops 152 prevent rotation of the hollow sleeve 30 when attached to the inner container 20, and an elastomeric O-ring may be included for inhibiting leaking of liquids through the prong aperture 160 when engaged with the resilient prong 150.

In some embodiments, each attachment mechanism 40 includes a first part 180 slidably fixed with one of the hollow sleeves 30, and a second part 190 fixed with one end 25 of the inner container 20. The first and second parts 180,190 are mutually fixed at a hinge 200, preferably a living hinge wherein the first and second parts 180,190 and the hinge 200 are integrally formed from a molded plastic material or the like. Each attachment mechanism 40 may include at least one magnet 133 and at least one magnetically-attractive material 134 (which may be another magnet 133), wherein the first and second parts 180,190 are mutually magnetically attracted when abutting and lying generally mutually parallel. Such a magnetic attraction is relatively easily broken by pivoting the hollow sleeve 30 down with respect to the inner container 20, the length of the hollow sleeve 30 providing leverage. When pivoting the hollow sleeve 30 upwardly to become aligned with the inner container 20, magnetic attractions pulls the first part 180 and the second part 190 mutually together, after which the hollow sleeve 30 is slid over the internal container 20 to achieve the collapsed configuration 60.

Each first part 180 of the attachment mechanism 40 may further include a plurality of dividers 210 that define holding apertures 220 (FIG. 15) within the first part 180 of the attachment mechanism 40 for holding elongated items 15 substantially vertically when the collapsible container 10 is in the deployed configuration 70 and resting on a horizontal support surface 18.

Alternately, the first part 180 of the attachment mechanism 40 is fixed with one of the hollow sleeves 30 at a hinge 200, and the second part 190 is a retaining bar 235 slidably fixed with a track 230 the inner container 30 (FIGS. 18-21). The track 230 includes a stop 237 which contacts a retaining prong 236 of the retaining bar 235 when the hollow sleeve 30 reaches the end 25 of the inner container 20, at which point the hollow sleeve 30 may be pivoted downwardly towards the deployed configuration 70. The track 230 retains the retaining bar 235 and retaining prong 236 therein. When collapsing the container 10 back into the collapsed configuration 60, the hollow sleeve 30 is pivoted upwards until aligned with the inner container 20, and then pushed towards a central raised section 120 of the inner container 20. The central raised section 120 includes a recess 238 for accommodating the retaining bar 235 and the retaining prongs 236 therein when the container 10 is in the collapsed configuration. Such an embodiment may include the cover 140, also with the central raised section 120, so that the inner container 20 is flush with each hollow sleeve 30 therearound when in the collapsed configuration 60. In either case the first part 180 may be removable from the hollow sleeve 30, or alternately fixed at the first open end 32 thereof, as desired.

In some embodiments the open first ends 32 of each hollow sleeve 30 include a plurality of raised edges 134 (FIGS. 9 and 10) and lowered edges 136 that mate together when each hollow sleeve 30 is in the collapsed configuration 60. As such, the lowered edges 136 are adapted to temporarily retain an elongated one of the items 15, such as a paint brush, tooth brush, or the like.

While a particular form of the invention has been illustrated and described, it will be apparent that various modifications can be made without departing from the spirit and scope of the invention. For example, particular shapes of the inner container 20, compartments 80 therein, fold-out trays 110, and hollow sleeves 30 are illustrated in the drawings. However, other shapes for these elements could easily be utilized without changing the spirit or scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A collapsible container for holding items above a support surface, comprising:

an elongated inner container having an outer surface, two opposing ends and a central storage cavity therebetween for receiving the items therein;

two hollow sleeves each open at a first end and adapted for substantially covering up to one-half of the inner container; and two attachment mechanisms each fixed between one of the ends of the inner container and the first end of one of the hollow sleeves, each attachment mechanism adapted to attach the hollow sleeve with the end of the inner container at a support angle;

whereby in a collapsed configuration the sleeves cover the opposing ends of the inner container, and in a deployed configuration each sleeve is fixed proximate the first open end thereof with one end of the inner container to support the inner container above the support surface.

2. The collapsible container of claim 1 wherein the central storage cavity is divided into a plurality of compartments with at least one compartment divider.

3. The collapsible container of claim 1 wherein the central storage cavity further includes a removable shallow tray, whereby some of the items may be retained in the tray and some of the items may be retained in the central storage cavity below the removable tray.

4. The collapsible container of claim 1 wherein the central storage cavity further includes at least one fold-out tray pivotally attached with the central storage cavity by at least one pivot, whereby when in the deployed configuration the at least one fold-out tray may be pivoted about the central storage cavity for holding at least one of the items.

5. The collapsible container of claim 1 wherein each hollow sleeve covers less than one-half of the length of the inner container when in the collapsed configuration, and wherein the inner container includes a central raised section that abuts the open first ends of the hollow sleeves when in the collapsed configuration.

6. The collapsible container of claim 1 wherein each hollow sleeve covers substantially one-half of the length of the inner container when in the collapsed configuration, the open first ends of the hollow sleeves abutting when in the collapsed configuration.

7. The collapsible container of claim 6 wherein the open first ends of each hollow sleeve include a mutual locking mechanism, wherein when in the collapsed configuration the open first ends of each sleeve may be selectively locked together to lock the collapsible container in the collapsed configuration.

8. The collapsible container of claim 7 wherein the mutual locking mechanism includes a flange proximate the open first end of each hollow sleeve and a clip selectively slidable around each flange to secure each flange together.

9. The collapsible container of claim 7 wherein the mutual locking mechanism includes at least one magnet fixed with the open first end of at least one of the hollow sleeves, and at least one magnetically attractive material fixed with the open first end of at least one of the other hollow sleeves, such that when the open first ends of the hollow sleeves abut, the at least one magnet is magnetically fixed with the at least one magnetically attractive material to lock the collapsible container in the collapsed configuration.

10. The collapsible container of claim 7 wherein the mutual locking mechanism includes at least one detent fixed with the outer surface of the inner container and cooperating with each of the hollow sleeves to frictionally hold the collapsible container in the collapsed configuration.

11. The collapsible container of claim 1 further including a cover adapted to substantially cover the central storage cavity, the hollow sleeves cooperative with the cover to lock the cover in place over the central storage cavity when the container is in the collapsed configuration.

12. The collapsible container of claim 1 wherein the open first ends of each hollow sleeve include a plurality of raised edges and lowered edges, the edges mating together when each hollow sleeve is in the collapsed configuration, the lowered edges adapted to temporarily retain an elongated one of the items.

13. The collapsible container of claim 1 wherein each attachment mechanism includes a resilient prong extending away from one of the ends of the inner container and a prong aperture proximate the open first end of one of the hollow sleeves, the prong adapted for selective attachment through the prong aperture to retain the hollow sleeve on the end of the inner container in the deployed configuration.

14. The collapsible container of claim 7 wherein the mutual locking mechanism includes two detents fixed with the outer surface of the inner container and cooperating with a prong aperture traversing each of the hollow sleeves proximate the open first end thereof to frictionally hold the collapsible container in the collapsed configuration, and wherein each attachment mechanism includes a resilient prong extending away from one of the ends of the inner container, the prong adapted for selective attachment through the prong aperture to retain the hollow sleeve on the end of the inner container in the deployed configuration.

15. The collapsible container of claim 8 wherein the flange of each hollow sleeve is cooperative with a flange retaining mechanism fixed with each end of the inner container to selectively hold each hollow sleeve to the end of the inner container in the deployed configuration.

16. The collapsible container of claim 1 wherein each attachment mechanism includes a first part slidably fixed with one of the hollow sleeves, and a second part fixed with one end of the inner container, the first and second parts mutually fixed at a hinge.

17. The collapsible container of claim 16 wherein each attachment mechanism further includes at least one magnet and at least one magnetically-attractive material, the first and second parts of each attachment mechanism being mutually magnetically attracted when abutting and lying generally mutually parallel.

18. The collapsible container of claim 17 wherein the first part of each attachment mechanism further includes a plurality of dividers that define holding apertures within the first part of the attachment mechanism for holding elongated items substantially vertically when the collapsible container is in the deployed configuration.

19. The collapsible container of claim 1 wherein each attachment mechanism includes a first part fixed with one of the hollow sleeves, and a second part slidably fixed with one end of the inner container, the first and second parts mutually fixed at a hinge.

20. The collapsible container of claim 19 wherein each attachment mechanism further includes at least one magnet and at least one magnetically-attractive material, the first and second parts of each attachment mechanism being mutually magnetically attracted when abutting and lying generally mutually parallel.

21. The collapsible container of claim 11 wherein the cover further includes at least one mirror adjustably fixed with the inner container so that the mirror can be adjusted in tilt and rotation when the container is the deployed configuration.

* * * * *